US005146271A

United States Patent [19]

Hoover

[11] Patent Number: 5,146,271

[45] Date of Patent: Sep. 8, 1992

[54] FUSING STATION HAVING RELEASE-OIL LEVEL DETECTOR

[75] Inventor: Linn C. Hoover, Rochester, N.Y.

[73] Assignee: Eastman Kodak Company, Rochester, N.Y.

[21] Appl. No.: 706,488

[22] Filed: May 28, 1991

[51] Int. Cl.[5] ..... G06G 15/20

[52] U.S. Cl. ..... 355/206; 355/284; 219/216

[58] Field of Search ..... 355/206, 284, 282, 283, 355/289, 290; 219/216; 222/51, 54, 56, DIG. 1; 340/622, 618

[56] References Cited

U.S. PATENT DOCUMENTS

| | | | |
|---|---|---|---|
| 3,883,291 | 5/1975 | Cloutier et al. | 355/284 |
| 4,413,255 | 11/1983 | Cohen et al. | 222/54 X |
| 4,536,076 | 8/1985 | Bickerstaff et al. | 355/284 |
| 4,743,943 | 5/1988 | Adams et al. | 355/284 |
| 4,870,445 | 9/1989 | Collier et al. | 355/282 |
| 4,870,446 | 9/1989 | Bickerstaff et al. | 355/282 |
| 4,924,271 | 5/1990 | Brinton et al. | 355/284 |
| 4,942,433 | 7/1990 | Stuart | 355/284 |
| 4,972,232 | 11/1990 | Hoover et al. | 355/295 |
| 4,994,862 | 2/1991 | Hoover | 355/284 |
| 5,043,768 | 8/1991 | Baruch | 355/284 |
| 5,045,889 | 9/1991 | Hoover | 355/284 |
| 5,049,943 | 9/1991 | Menjo et al. | 355/284 |

*Primary Examiner*—R. L. Moses
*Attorney, Agent, or Firm*—Tallam I. Nguti

[57] ABSTRACT

A heat and pressure fusing station in an electrostatographic copier or printer includes a level detecting apparatus for detecting a low oil level condition in a release oil reservoir of such a fusing station. The level detecting apparatus includes a temperature responsive thermistor connected to a voltage divider and a voltage comparator circuit, and supported within the reservoir so as to be exposed and above the level of release oil in the reservoir when there is a low oil condition in the reservoir.

11 Claims, 2 Drawing Sheets

FUSING STATION HAVING RELEASE-OIL LEVEL DETECTOR

BACKGROUND OF THE INVENTION

1. Field of the Invention

This invention relates to fuser and pressure roller-type fusing stations for fusing toner images in an electrostatographic apparatus such as copiers and printers. More particularly, this invention relates to such a fusing station that includes a release-oil level detector.

2. Description Relative to the Prior Art

In electrostatographic apparatus such as copiers and printers, fuser and pressure roller-type fusing stations as disclosed for example in U.S. Pat. Nos. 4,870,445 and 4,870,446 issued Sep. 26, 1989 in the names of Collier et al. and Bickerstaff et al., respectively, are well known for fusing toner images on suitable receivers. Usually, the fuser roller of such a station is heated, and rotatably forms a fusing nip with an unheated pressure roller. A suitable receiver sheet with an unfused toner image thereon is fed through the fusing nip such that the heated fuser roller directly contacts and heats the toner image on the receiver sheet.

A common problem associated with such fusing stations is that the toner particles which form the toner image, partially offset undesirably from the receiver sheet onto the surface of the fuser roller. As disclosed, for example, in the patents cited above, and in commonly assigned U.S. Pat. No. 4,994,862, issued Feb. 19, 1991 in the name of the present inventor Linn C. Hoover, such an offsetting problem can be prevented by the application of release oil to the surface of the fuser roller.

Typically, a system for supplying and applying such release oil is mounted in a remote and blind location within a copier or printer, and includes a reservoir that can hold a substantial quantity of such oil. The oil is withdrawn from the reservoir by suitable means, and is used up by being applied to, and released from, the surface of the fuser roller. Eventually, however, the quantity of oil in the reservoir can all run out or be all used up, and if not replenished, can undesirably result in reoccurrence of the toner offsetting problem, and hence in poorly fused images from the fusing station. There is, therefore, a need for a simple and reliable release oil level detector for use in association with such a reservoir in order to prevent such a run out and reoccurrence of the toner offsetting problem.

SUMMARY OF THE INVENTION

It is an object of the present invention to provide a simple and reliable apparatus for detecting a low oil level condition in the release oil reservoir of an electrostatographic fusing station.

It is another object of the present invention to provide such a level detecting apparatus that has relatively few parts.

In accordance with the present invention, a release oil level detecting apparatus is provided for detecting a low oil level condition in a release oil reservoir of the release oil supply system of an electrostatographic fusing station. The level detecting apparatus includes first means which constitute a voltage divider circuit that comprises a power source with an input voltage $R_{IN}$, an output voltage $V_{OUT}$, a reference resistance $R_r$, and a temperature responsive variable resistance means $R_T$. The level detecting apparatus also includes a voltage comparator circuit means, and means for supporting the variable resistance means $R_T$ within the reservoir such that such means $R_T$ is above the level of release oil in the reservoir when a low oil level condition exists in the reservoir. The voltage comparator circuit means is connected to the voltage divider circuit means for sensing a sudden change in the output voltage $V_{OUT}$ of the voltage divider circuit means. The level detecting apparatus further includes alerting means which are connected to the voltage comparator circuit means for signaling the existence of such a low oil level condition in response to such a sensed change in the output voltage $V_{OUT}$ of the voltage divider circuit means.

BRIEF DESCRIPTION OF THE DRAWINGS

In the detailed description of the invention presented below, reference is made to the drawings in which.

DETAILED DESCRIPTION OF THE INVENTION

Figure 1:
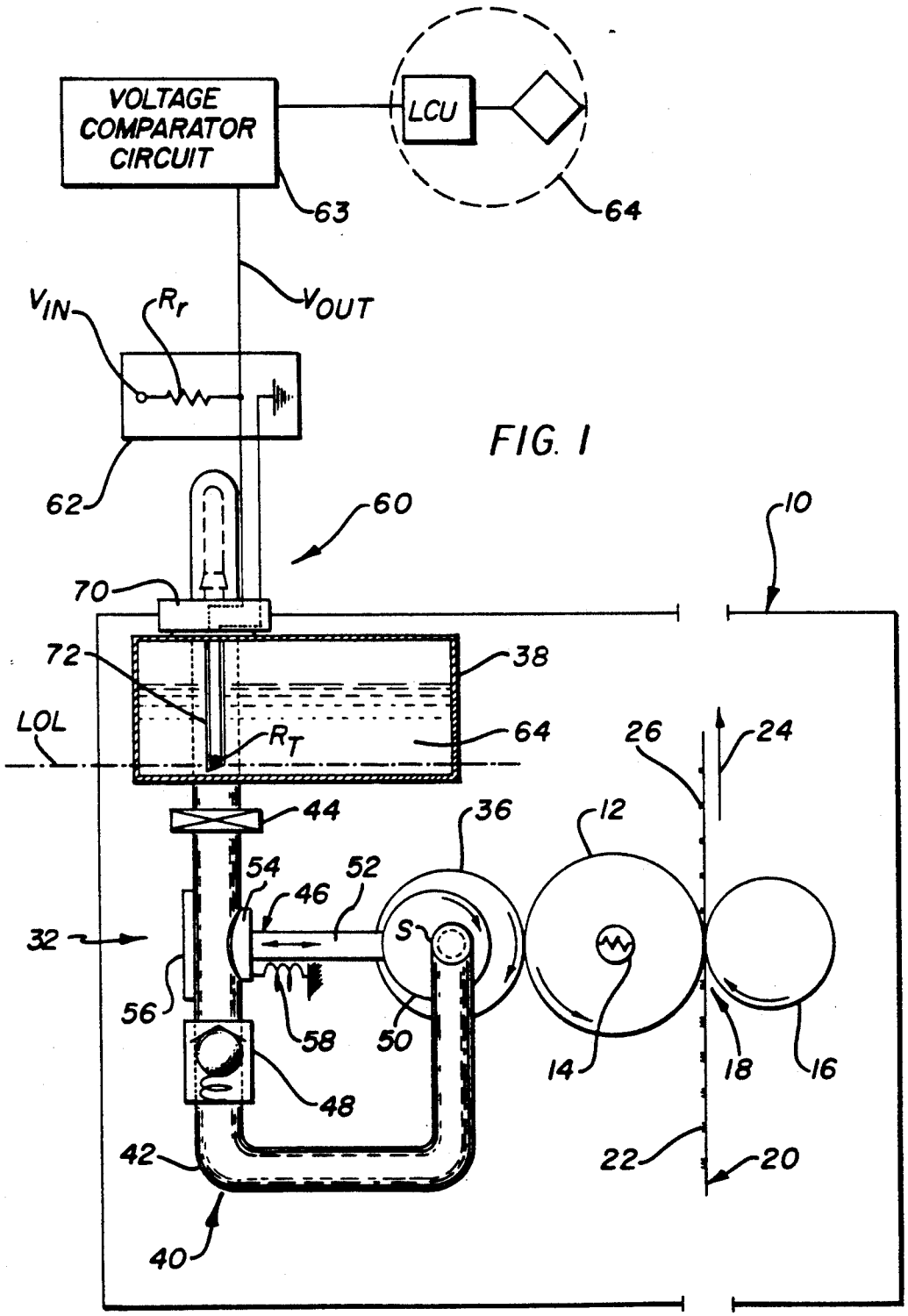
FIG. 1 is an elevational end view (partly in section) of the fusing apparatus of an electrostatographic process machine including the apparatus of the present invention.
Figure 2:
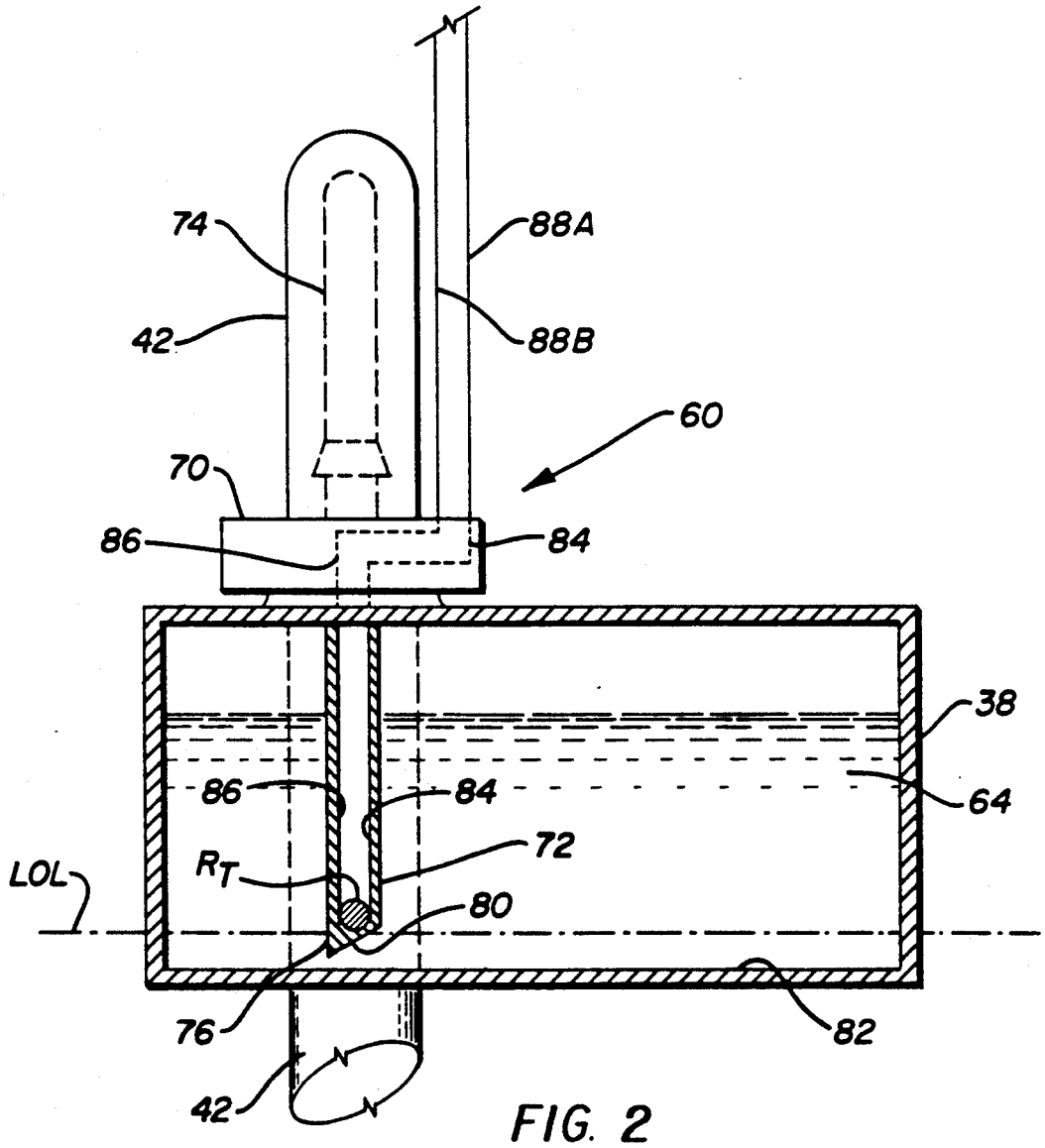
FIG. 2 is an enlarged view of the reservoir of the present invention.

Because fusing stations or apparatus are well known for use in electrostatographic process machines such as copiers and printers, the description of the present invention will be directed in particular to elements of such a fusing apparatus forming part of, or cooperating more directly with, the present invention. Elements of such a fusing station not specifically shown or described herein are ordinarily selectable from those known in the prior art.

Referring now to the drawing, a fuser and pressure roller-type fusing apparatus or station, for use in an electrostatographic process machine such as a copier or printer, is shown generally as 10. Further details regarding such a copier or printer may be found, for example, in U.S. Pat. No. 4,791,450, the contents of which are incorporated herein with this reference. As shown, the fusing station or apparatus 10 includes a rotatable heated fuser roller 12, means 14, such as a quartz lamp for heating the fuser roller 12, and a rotatable pressure roller 16 which forms a fusing nip 18 with the fuser roller 12. As is well known, the fuser and pressure rollers 12 and 16, respectively, should have constructions suitable for producing clean, desirable fused images on a suitable receiver such as a copy sheet of paper 20. As is well known, the fuser roller 12 may also be heated externally by suitable means. The fusing apparatus 10, as such, can be used in an electrostatographic copier or printer to fuse unfused toner images 22 on the receiver 20 which is passed, for example, in the direction of arrow 24, through the fusing nip 18. The receiver 20 is passed therethrough such that the heated fuser roller 12 directly contacts and heats the unfused toner images 22 resulting in fused images 26.

The quality of the resulting fused images 26 exiting the nip 18 depends in significant part on prevention of the toner particles, which form the images 22, from offsetting from the sheet 20 to the surface of the fuser roller 12 during such fusing. To prevent such offsetting of the toner particles, the fusing apparatus 10 includes a release oil supply and application apparatus or system 32. The system 32 contains a substantial supply of release oil, such as silicone oil, and applies such oil to the surface of the heated fuser roller 12.

As shown, the system 32 includes a reservoir 38 for holding the release oil, a porous release oil application roll 36, and feed means 40 for automatically feeding the release oil from the reservoir 38 to the application roll 36. The reservoir 38, as shown, is connected by an oil feed tube 42 to the application roll 36. The feed tube 42, as such, is part of the feed means 40 and is made of a flexible or resilient material to allow it to be pinched. The release oil application roll 36, for example, is mounted fixedly on, and for rotation with, a rotatable shaft S such that the roll 36 frictionally contacts the surface of the fuser roller 12. Mounted as such, rotation of the fuser roller 12, for example by the copier's drive (not shown), frictionally drives the application roll 36, thereby causing the roll 36 to continuously apply release oil thereto. Additionally, such frictional rotation of the application roll 36 also in turn rotates the shaft S which is fixedly connected to the roll 36.

As shown, the feed means 40 may include the feed tube 42, a one-way check valve 44, a cam driven pressure bar assembly 46, a relief valve 48, and a cam 50 cooperating with the pressure bar assembly 46. The cam driven pressure bar assembly 46 is mounted for contacting the feed tube 42 below the check valve 44. The assembly 46 includes a pressure bar 52 that has a tail or first end, and a large arcuate head 54 for directly contacting the feed tube 42. It also includes a stationary pressure plate 56, and a return spring 58 that is connected to the moving head 54 of the pressure bar 52. The pressure bar 52 is movable in the direction of the arrows shown and has a feed tube compressing position and a feed tube release position relative to the tube 42. The pressure plate 56 is mounted on the side of the feed tube 42 that is directly across from, and opposite the point of contact between the feed tube 42 and the head 54 of bar 52. The spring 58 functions to return the pressure bar 52 to the right in FIG. 1 from its tube compressing position to its tube release position when the bar is released by cam 50.

The cam 50, like the application roller 36, is also mounted fixedly on the shaft S for rotation therewith. As mounted, the cam 50 is in continuous rotating contact with the first or tail end of the pressure bar 52 which is biased against the cam 50 for intermittently driving the pressure bar 52 from its tube release position into compressing contact with the feed tube 42. Such compressing and squeezing contact with the tube 42 pumps and feeds release oil within the tube to the application roll 36. Feeding of the oil from the reservoir 38, as such, or by other suitable means, causes the level of the oil therein to drop.

In order to prevent the reoccurrence of the problem of toner particles offsetting from the sheet 20 to the fuser roller 12 when the system 32 runs out of oil, the present invention provides a level detecting system or apparatus designated generally as 60. The apparatus 60 is useful for detecting a low oil level or (LOL) condition in the reservoir 38. As shown, the apparatus 60 includes first means shown as 62 which constitutes a voltage divider circuit. The means 62 includes a constant current power source, for example a 100 milliamp service, that has an input voltage $V_{IN}$ of 24 VDC for example, an output voltage $V_{OUT}$, a fixed reference resistance $R_r$ for example of 155 ohms, and a temperature responsive variable resistance means $R_T$ such as a PTC thermistor having a shelf resistance of 50–150 ohms at 25° C. (77° F.).

The level detecting apparatus 60 also includes a voltage comparator circuit means 63 and means 72 for supporting the variable resistance means $R_T$ within the reservoir 38 such that the thermistor $R_T$ is immersed in release oil 64 when there is sufficient oil in the reservoir but is above the level LOL of oil in the reservoir and exposed when a low oil level condition exists in the reservoir 38. The voltage comparator circuit means 63 is connected to the voltage divider circuit means 62 for sensing a sudden change, for example a sudden drop, in the output voltage $V_{OUT}$ of the voltage divider circuit 62. Alerting means shown as 64 may be connected through an LCU (logic and control unit) to the voltage comparator circuit 63 for generating a signal signaling the existence of such a low oil level condition in response to the sudden drop in voltage output of the divider circuit. The alerting means 64 can be a sound alarm or a warning light on an operator control panel. In addition, besides actuating the alerting means, the LCU can be programmed to output a signal to shut down the entire electrostatographic reproduction apparatus for example after a predetermined number of copies, should the alerted low oil level condition remain uncorrected.

As shown, the means 72 for supporting the thermistor $R_T$ within the reservoir 38 consists of a siphon tube and includes a cap 70 for capping an aperture, for example at the top thereof, into the inside of the reservoir. The siphon tube 72 is fitted through the cap 70 as shown, and has an output end 74 that lies above the cap 70 and is associated with the oil feed tube 42. The siphon tube 72 also has an intake end 76 that has an intake port 80 for taking up oil from the reservoir. The intake end 76, as shown, lies below the cap 70 for positioning the intake port 80 as near as possible to the bottom 82 of the inside of the reservoir 38. The length of the siphon tube 72 is such that when the cap 70 is properly assembled to the reservoir, the intake port 80 of the tube 72 will lie Just below the predetermined low oil level line LOL inside the reservoir.

As further shown, the level detecting apparatus 60 includes electrically conductive traces 84, 86 which are formed into the walls of the tube 72, and of the cap 70. The traces 84, 86 have a first set of connecting means or terminals on the cap 70 and a second such set of connecting means or terminals at or near the intake end 74 of the tube 72. The conductive traces 84, 86 can be formed integrally with the siphon tube 72 and cap 70 for example by the "Mold-n-Plate" (trademark of Kollmorgen Corporation) process used by the Pathtek Company of Rochester, N.Y. It is a 3-dimensional process in which the traces are molded directly into the walls of the tube and cap 72, 70, respectively.

In the apparatus 60, the first set of terminals to the traces 84, 86 are appropriately connected as by soldering to electrical wiring means 88A, 88B, from the voltage divider and comparator circuits 62, 64, respectively. The second set of terminals of the traces 84, 86 near the intake port 80 are similarly connected appropriately as by soldering to the leads of the thermistor $R_T$ to complete the electrical connections of the apparatus 60. As supported and connected, the thermistor $R_T$ will be completely immersed in release oil when there is sufficient oil in the reservoir, but will be above the oil level and hence exposed to ambient temperature air above the oil level when the reservoir is in the predetermined low oil level (LOL) condition.

The thermistor $R_T$ should be selected such that when a predetermined amount of electrical current is passed through such thermistor, such current will cause the thermistor to heat up, and such that if the heat is not dissipated, the heat will suddenly cause a significant increase in the resistance value of the thermistor. As selected, the thermistor $R_T$ should be such that when in the ambient air above the release oil level within the reservoir 38, the current therethrough will cause such undissipated heating thereof, and hence a sudden increase in its resistance value. The amount of current through the thermistor should additionally be determined such that when such a thermistor is completely immersed in the release oil, the release oil in contact therewith, will quickly dissipate any heat therefrom caused by the current, thus preventing any significant increase in its resistance value.

For example, a successful level detecting apparatus 60 was built using a 100 milliamp current source at 24 volt DC, a fixed reference resistance $R_r$ of 155 ohms, and a PTC thermistor $R_T$ having a shelf resistance of 85 ohms at 25° C. (77° F.). The maximum temperature of the thermistor $R_T$ was about 120° F. when immersed in oil, and about 240° F. when then exposed in air above the oil level. The circuit resistance of the thermistor $R_T$ at about 240° F. was estimated to be about five times its shelf resistance value.

While the invention has been described with regard to a temperature responsive thermistor, those skilled in the art will recognize that other temperature responsive elements may be substituted for the thermistor, including transistors, diodes, etc. Detectors may detect changes in voltage, in current, or even the amount of light or color, for example of a light-emitting diode.

As can be seen, the present invention provides a simple and reliable level detecting apparatus 60 for detecting a low oil level condition in the release oil reservoir 38. The apparatus 60 has relatively few parts and yet is effective in preventing reoccurrence of a toner offsetting problem in the fusing station of the present invention.

The invention has been described in detail with particular reference to a presently preferred embodiment, but it will be understood that variations and modifications can be effected within the spirit and scope of the invention.

What is claimed is:

1. In a release oil supply system, of an electrostatographic fusing station, including a release oil reservoir, a level detecting apparatus for detecting a low oil level condition in such reservoir, the level detecting apparatus comprising:

(a) first means constituting a voltage divider circuit and including a power source having an input voltage $V_{IN}$, and output voltage $V_{OUT}$, a reference resistance $R_r$, and a temperature responsive variable resistance means $R_T$;

(b) means including a siphon tube having an electrically conductive trace embedded therein for supporting said temperature responsive resistance means $R_T$ within the reservoir such that said means $R_T$ is above the level of release oil therein when a low oil level condition exists in the reservoir;

(c) voltage comparator circuit means connected to said electrically conductive trace and to said voltage divider circuit means for sensing a sudden change in the output voltage $V_{OUT}$ of said voltage divider circuit; and (d) alerting means connected to said voltage comparator circuit means for signaling the existence of such a low oil level condition in response to such a sensed change in the output voltage $V_{OUT}$ of said divider circuit.

2. The level detecting apparatus of claim 1 wherein said power source is a constant current source.

3. The level detecting apparatus of claim 1 wherein said variable resistance means $R_T$ is a thermistor.

4. A level detecting apparatus for detecting a low oil level condition in a fuser oil reservoir of an electrostatographic apparatus, the level detecting apparatus including:

(a) a cap for capping a top aperture into the oil reservoir;

(b) a siphon tube passing through said cap, said siphon tube having an output end above said cap and an intake end including an intake port for positioning near the bottom of the inside of said reservoir;

(c) an electrically conductive trace embedded in the wall of said siphon tube and including first and second connecting means towards said output and said input ends respectively of said tube;

(d) a temperature responsive thermistor attached close to said intake port of said tube, said thermistor being connected to said second connecting means of said conductive trace for forming part of a voltage divider circuit; and (e) electrical circuit means including a power source, a voltage comparator circuit, and alerting means for signaling the existence in said reservoir of a low oil level condition.

5. The level detecting apparatus of claim 4 wherein said thermistor is selected such that in ambient air above the level of release oil in said reservoir, a predetermined amount of current passed therethrough will heat the thermistor and will cause a sudden increase in the resistance value thereof.

6. The level detecting apparatus of claim 4 wherein said power source is a constant current source.

7. The level detecting apparatus of claim 4 wherein said thermistor is selected such that when immersed in the release oil in said reservoir, a predetermined amount of current passed through the thermistor will heat the thermistor, but such heat will be quickly dissipated by the release oil in contact therewith.

8. The level detecting apparatus of claim 4 wherein said thermistor is attached to said siphon tube at a point whereat said thermistor will be immersed in such oil when there is sufficient oil in the reservoir, but will be exposed in ambient air above the level of release oil when oil in the reservoir is at or below a predetermined low level.

9. The level detecting apparatus of claim 4 wherein said alerting means consists of logic and control means, and message means on an operator control panel.

10. In an electrostatographic apparatus, a fusing apparatus for fusing toner images on a receiver sheet, the fusing apparatus comprising;

(a) a heated fuser roller having an outside surface suitable for directly contacting and heating the toner images being fused;

(b) a pressure roller forming a fusing nip with said fuser roller; and (c) an oil application system for applying toner release oil to the outer surface of said fuser roller, said oil application system including a reservoir of toner release oil and level detecting means for detecting a low oil condition in said reservoir, said level detecting means including a temperature responsive means $R_T$ connected to a siphon tube having an electrically conductive trace embedded therein, and to electrical power means, including a constant current power source, said temperature responsive means being supported at just above a predetermined low oil level position within said reservoir so as to be immersed in oil when there is sufficient oil in said reservoir but exposed and above the level of oil, when oil in the reservoir is at or below such predetermined low level position and said level-detecting means generating a signal in response to a change in temperature of said temperature responsive means for indicating a low oil condition in said reservoir.

11. A level-detecting apparatus for detecting a low oil condition in a reservoir containing fusing release oil, the apparatus including:

(a) electrical response means having a temperature responsive element for generating a signal in response to a temperature of said temperature responsive element;

(b) means including a siphon tube having an electrically conductive trace connected to said temperature responsive elements and embedded in a wall of said tube, for supporting said temperature responsive means at a low oil condition position in said reservoir so that said element is ordinarily immersed in oil but exposed in a low oil condition, and so that heat from said temperature responsive element can be absorbed by oil when immersed therein; and (c) alerting means responsive to an output signal from said temperature responsive element when exposed for alerting a low oil condition in said reservoir.

* * * * *